US011066819B2

(12) United States Patent
Rosario

(10) Patent No.: US 11,066,819 B2
(45) Date of Patent: Jul. 20, 2021

(54) DRAIN STOPPER WITH REMOVABLE DEBRIS TRAP

(71) Applicant: Israel Rosario, Hollywood, FL (US)

(72) Inventor: Israel Rosario, Hollywood, FL (US)

( * ) Notice: Subject to any disclaimer, the term of this patent is extended or adjusted under 35 U.S.C. 154(b) by 0 days.

(21) Appl. No.: 16/263,480

(22) Filed: Jan. 31, 2019

(65) Prior Publication Data

US 2019/0242102 A1 Aug. 8, 2019

Related U.S. Application Data

(60) Provisional application No. 62/709,820, filed on Feb. 2, 2018.

(51) Int. Cl.
*E03C 1/262* (2006.01)
*E03C 1/22* (2006.01)

(52) U.S. Cl.
CPC ..... *E03C 1/262* (2013.01); *E03C 1/22* (2013.01)

(58) Field of Classification Search
CPC ... E03C 1/262; E03C 1/22; E03C 1/26; E03C 1/264
USPC ..... 4/287
See application file for complete search history.

(56) References Cited

U.S. PATENT DOCUMENTS 5,003,642 A * 4/1991 Robb ..... E03C 1/262 210/164
6,263,518 B1 * 7/2001 Magtanong ..... E03C 1/26 4/286
2009/0151060 A1 * 6/2009 Zubillaga ..... E03C 1/262 4/292
2010/0115689 A1 * 5/2010 Thompson ..... E03C 1/264 4/287
2014/0165275 A1 * 6/2014 Zito ..... E03C 1/264 4/292
2016/0040412 A1 * 2/2016 Fetkovich ..... E03C 1/264 4/292
2016/0251839 A1 * 9/2016 Ali ..... E03C 1/2302 4/287
2016/0265204 A1 * 9/2016 Zito ..... B08B 9/027

* cited by examiner

*Primary Examiner* — Benjamin R Shaw
(74) *Attorney, Agent, or Firm* — The Rapacke Law Group, P.A.

(57) ABSTRACT

A drain stopper assembly with a removable debris trap is comprised of a debris trap releasably engaged with a drain stopper assembly. The debris trap is comprised of a plurality of radially extending bristles extending from an outer surface. The plurality of bristles is arranged to trap debris entering a drain outlet.

12 Claims, 6 Drawing Sheets

DRAIN STOPPER WITH REMOVABLE DEBRIS TRAP

CROSS-REFERENCE TO RELATED APPLICATIONS

This application claims priority to U.S. Provisional Application 62/709,820 entitled "Super Hair Trap" and filed Feb. 2, 2018, which is hereby incorporated by reference in its entirety.

TECHNICAL FIELD

The embodiments generally relate to devices which prevent the clogging of drainpipes of bathtubs, sinks, and the like.

BACKGROUND

Sinks, showers, and bathtubs contain a drainage outlet to permit the egress of water from the reservoir. The drainage outlet may be open or contain a drain protector to act as a sieve by removing debris from the flow of water before its entrance into the drain. Some drainage outlets are equipped with a pop-up plug allowing the user to selectively retain water in the reservoir before drainage.

Even with the use of a drain cover, drainpipes often become clogged due to the buildup of debris washed away by the flow of water. The leading cause of clogging is the accumulation of hair which slowly builds over time until the water no longer drains effectively. The inability of water to drain may result in unsanitary conditions and provides a medium for harboring bacteria and waterborne pathogens.

Drain cleaners are often classified into two categories: either chemical or mechanical. Mechanical devices for hair removal include drain snakes which use a thin, flexible auger to dislodge clogs in the drainpipe. While effective, the device is expensive and requires special skills to use effectively. Other mechanical devices include air burst drain cleaners which use accelerated carbon dioxide, air, or other gas to rupture the clog membrane. Airburst cleaners are limited in their cleaning range in pipes that do not contain standing water and, in general, are ineffective in unclogging larger drains.

Chemical-based drain cleaners use an alkaline or acidic composition. The most common chemical is highly concentrated sulfuric acid which can dissolve cellulose, proteins, and fats. Such harsh chemicals are potentially dangerous if used improperly, and repeated use often results in damage to the drainpipes, leading to expensive repairs. Further, the chemicals found in drain cleaners may react with household products and cause explosive, or highly toxic reactants.

SUMMARY OF THE INVENTION

This summary is provided to introduce a variety of concepts in a simplified form that is further disclosed in the detailed description of the invention. This summary is not intended to identify key or essential inventive concepts of the claimed subject matter, nor is it intended for determining the scope of the claimed subject matter.

The embodiments described herein provide for a drain stopper assembly with a removable debris trap to prevent debris in wastewater from entering a drainpipe without the use of chemicals. The drain stopper assembly includes a central portion extending between a stem and a removable cap. A removable debris trap slidingly engages with the central portion and is retained between the stem and the removable cap. The removable debris trap is comprised of a plurality of bristles radially extending from a plurality of apertures positioned through the outer surface of the removable debris trap to catch debris entering the drain outlet without restricting the flow of wastewater.

In one aspect, the removable debris trap is dimensioned to be at least partially disposed in a drainpipe.

In one aspect, the cap is threadingly engaged with the central portion such that the removal of the cap permits the removal of the removable debris trap. The removable debris trap may be replaced by the user.

In one aspect, the apparatus can be placed in a lowered position wherein the cap is hermetically sealed with a drain outlet to prevent the drainage of wastewater into a drainpipe. Further, the apparatus may be placed in a raised position wherein the cap is positioned at a distance from the drain outlet to permit the drainage of wastewater into the drainpipe.

In one aspect, the removable drain trap is disposable such that the user is not required to untangle, or otherwise remove the debris from the debris trap.

BRIEF DESCRIPTION OF THE DRAWINGS

A complete understanding of the present invention and the advantages and features thereof will be more readily understood by reference to the following detailed description when considered in conjunction with the accompanying drawings wherein.

DETAILED DESCRIPTION

The specific details of the single embodiment or variety of embodiments described herein are to the described apparatus. Any specific details of the embodiments are used for demonstration purposes only and not unnecessary limitations or inferences are to be understood therefrom.

Before describing in detail exemplary embodiments, it is noted that the embodiments reside primarily in combinations of components related to the apparatus.

As used herein, relational terms, such as "first" and "second" and the like, may be used solely to distinguish one entity or element from another entity or element without necessarily requiring or implying any physical or logical relationship or order between such entities or elements.

As used herein, the term "debris" may refer to any object that may be transferred into a drain outlet and the drainpipe. By way of non-limiting example, the debris may include hair, hairpins, soaps and detergents, dust, dirt, cosmetic products, jewelry, or other small particles and objects.

In general, the embodiments relate to a drain stopper configured to be at least partially inserted into a drain outlet. The drain stopper may be configured to be used in any plumbing fixture having a drain outlet including, but not limited to a floor drain, sink, bathtub, shower, lavatory, or similar drains wherein debris may cause a clog resulting in the inability to drain fluids. The drain stopper is comprised of a removable debris trap configured to filter and trap debris from obstructing the flow of water before the debris continues further into the drainpipe.

Figure 1:
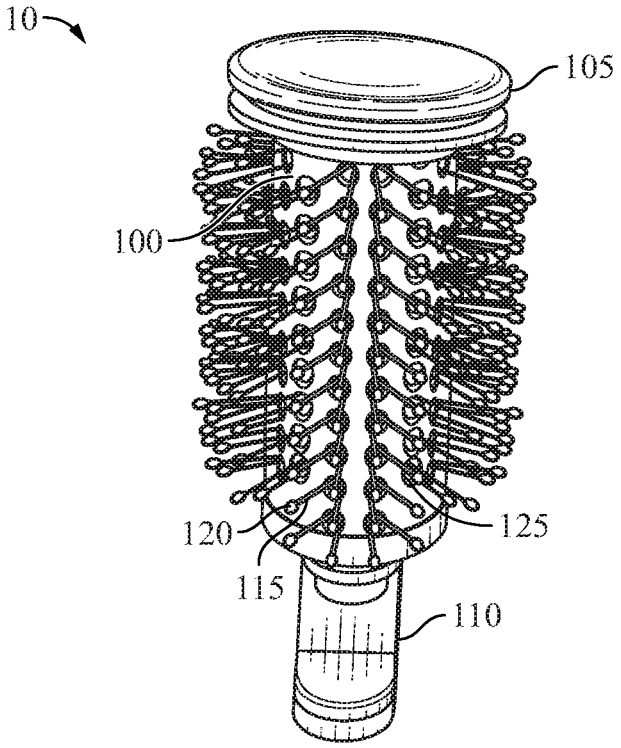
FIG. 1 illustrates a perspective view of the drain stopper and removable debris trap, according to some embodiments.

FIG. 1 illustrates the drain stopper apparatus 10 having a cap 105 at its upper end which is complementary configured relative to a drain outlet opening such that the cap 105 can engage with the drain opening to prevent wastewater from draining from the sink, shower, or similar plumbing fixture. The apparatus 10 includes a stem 110 positioned at a lower end which extends into the drain pipe and provides a means for positioning the apparatus 10 in either a raised or lowered position, wherein the raised position allows for the flow of wastewater, and the lowered position allows for the retention of wastewater. A debris trap 100 extends between the cap 105 and the stem 110 and is comprised of a plurality of bristles 115 and ends 120 extending radially from apertures 125 positioned through the surface of the debris trap 100.

In some embodiments, each of the plurality of apertures 125 is dimensioned to receive a plurality of bristles 115 therethrough. Bristles 115 are arranged to entangle debris present in the flow of wastewater.

Figure 2:
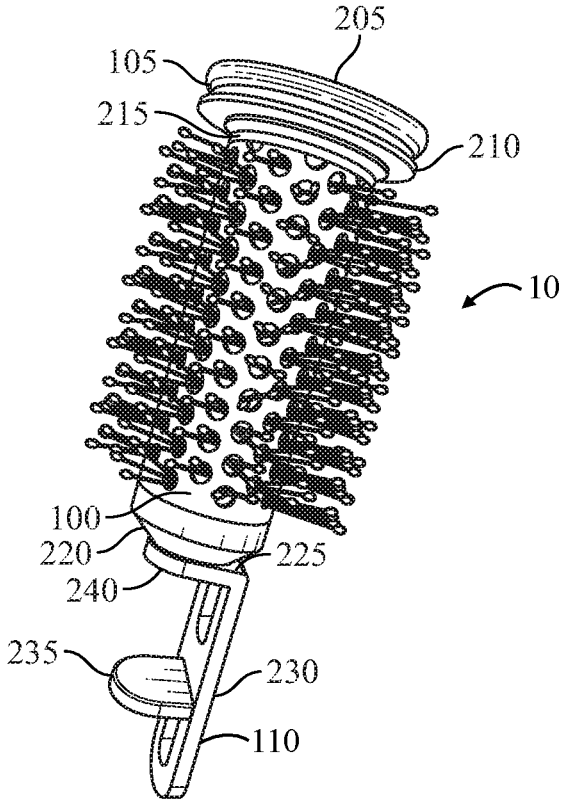
FIG. 2 illustrates a right side elevational view of the drain stopper and removable debris trap, according to some embodiments.
Figure 3:
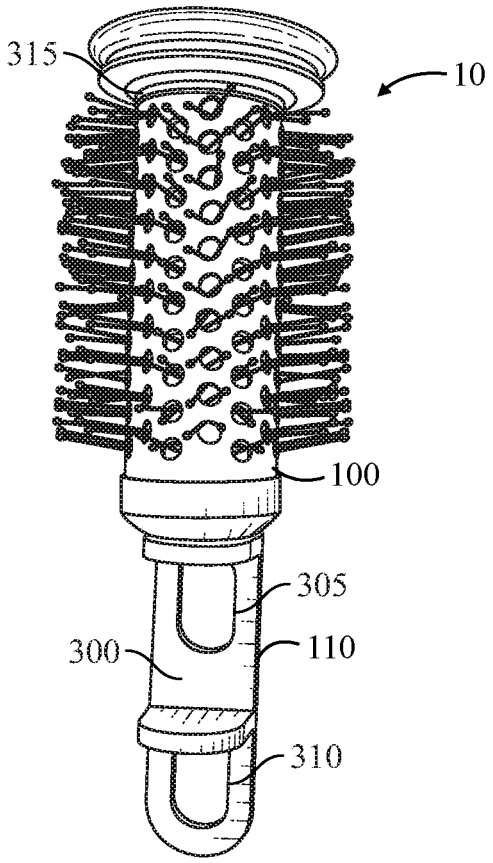
FIG. 3 illustrates a perspective view of the drain stopper and removable debris trap, according to some embodiments.

FIG. 2 illustrates the cap 105 having a top portion 205 and a bottom portion 210, wherein the bottom portion 210 is removably engaged with the debris trap 100. In some embodiments, the cap 105 engages a threaded portion 215 of the apparatus 10. A bottom end 220 of the debris trap 100 via a top surface 225 of a member 240. The stem 110 can include an adjustment means 235 which allows the apparatus to be raised and lower in relation to the drain outlet. Similarly, FIG. 3 illustrates the apparatus 10 having apertures 305, 310 through the stem 110 which engage with the drain mechanism as known in the arts. In some embodiments, the cap 105 includes a snap-fit mechanism 315 to releasably engage with the debris trap 100.

Figure 4:
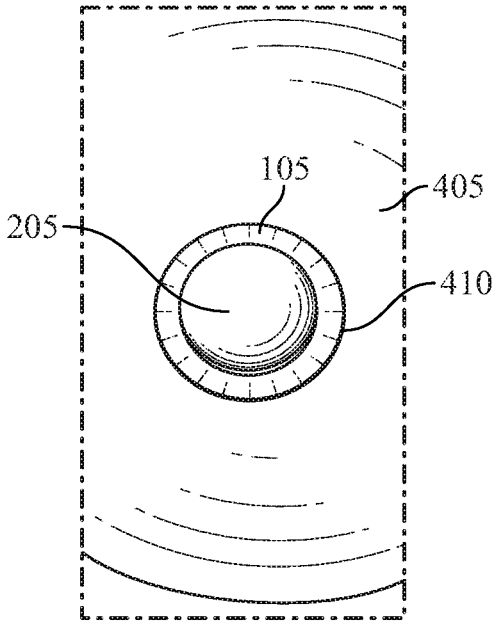
FIG. 4 illustrates a cutaway view of the drain stopper positioned in a drain outlet, according to some embodiments.

FIG. 4 illustrates a cutaway view of a sink 405 and top portion 205 of the cap 105 of the apparatus in a lowered position. The cap 105 is dimensioned to form a hermetic seal with the drain outlet seat 410 to prevent the drainage of wastewater. To form the sealed engagement, the cap 105 may rest on the top of the drain outlet seat 410 or may be configured to sufficiently contact the inner surface of the drainpipe.

Figure 5:
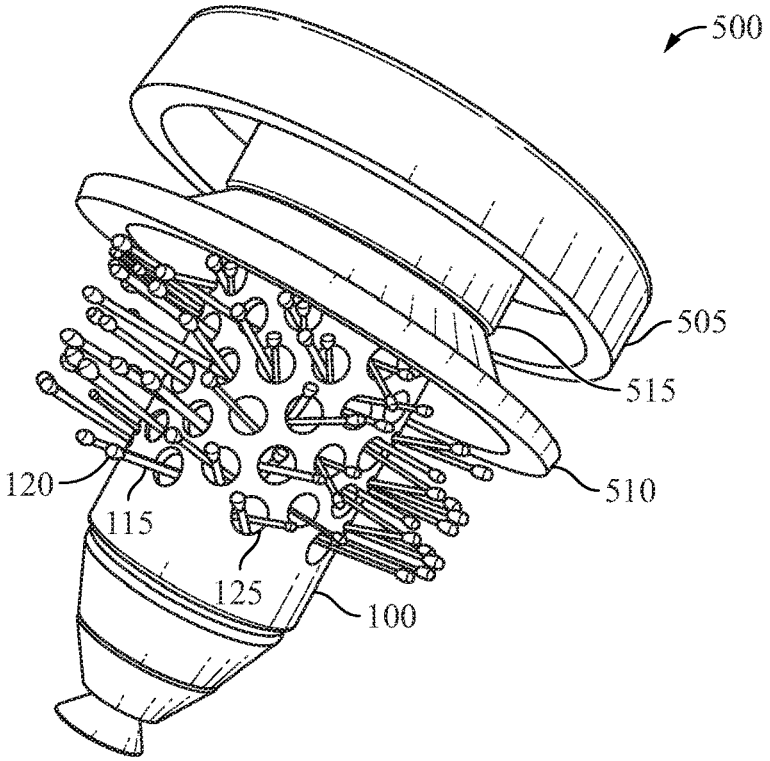
FIG. 5 illustrates a perspective view of the drain stopper for a bathtub or shower, according to some embodiments.
Figure 6:
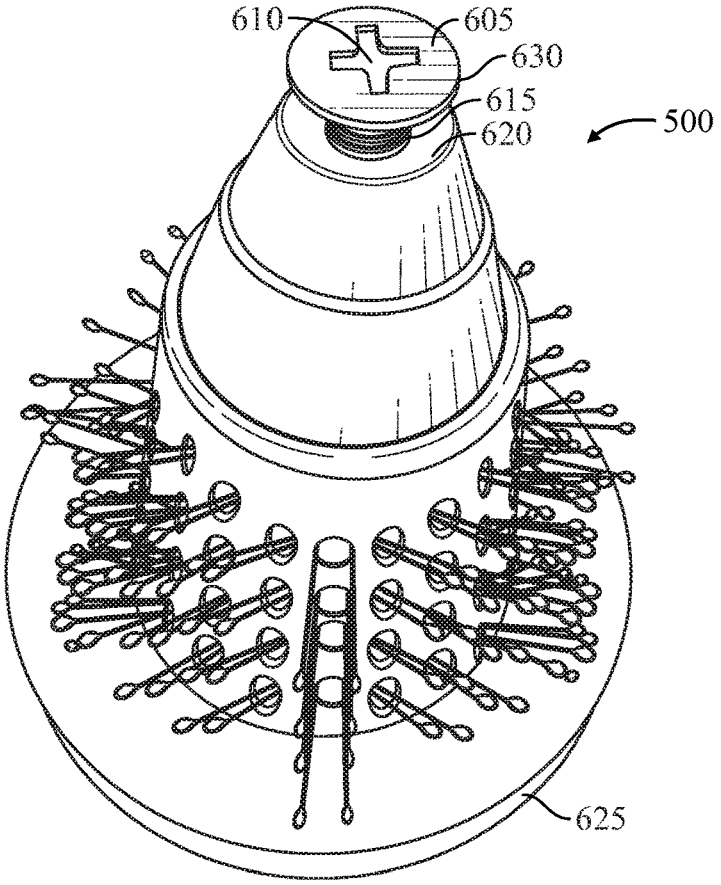
FIG. 6 illustrates a further perspective view of the drain stopper for a bathtub or shower, according to some embodiments.

FIG. 5 illustrates an alternate embodiment wherein the apparatus 10 is provided as a bathtub drain stopper 500 having the removable debris trap 100 including the bristles 115 and ends 120 extending through the plurality of apertures 125 as shown and described hereinabove. The bathtub drain stopper 500 is provided with an alternative plug 505 having a lower flange 510 connected to the plug 505 via a central portion 515 which are each configured to separate from the debris trap 100. FIG. 6 illustrates the bathtub drain stopper 500 having an adjustment mechanism 605 at a bottom end 630. The adjustment mechanism 605 may include a screw 610 having a threading 615 to engage with a bottom portion 620 of the bathtub drain stopper 500. A top portion 625 includes a removeable cap as described hereinabove.

Figure 7:
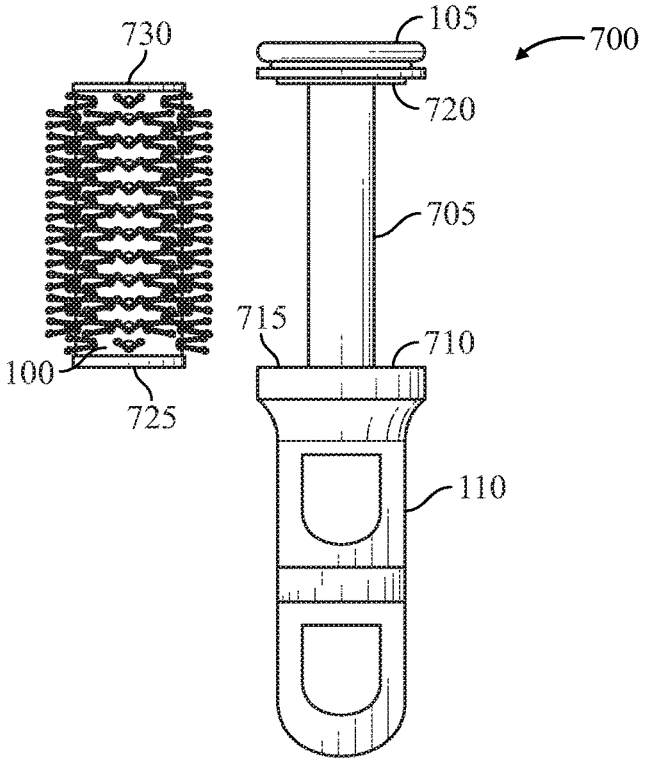
FIG. 7 illustrates a front elevational view of the drain stopper and the removable debris trap, according to some embodiments.

FIG. 7 illustrates an exemplary embodiment of the debris trap 100 removed from the assembly 700. The assembly 700 is comprised of a central portion 705 extending between the cap 105 and the stem 110. The central portion 705 is positioned through the debris trap 100 to retain the debris trap 100 on the assembly 700 during use. The debris trap 100 includes a lower rim 725 and an upper rim 730 wherein the lower rim 725 contacts a top end 710 of the stem 110 and the upper rim 730 contacts the bottom end 720 of the cap 105. The circumference of the top end 710 of the stem 110 is greater than the circumference of the lower rim 725 of the debris trap 100. Similarly, the circumference of the bottom end 720 of the cap 105 is less than the circumference of the upper rim 730 of the debris trap 100.

Figure 8:
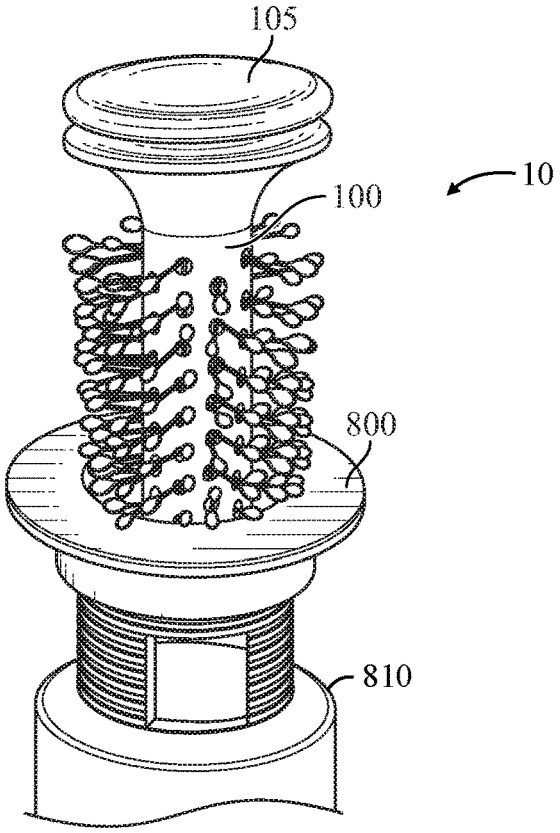
FIG. 8 illustrates a perspective view of the drain stopper and drain outlet, according to some embodiments.

FIG. 8 illustrates the apparatus 10 partially extruding from the drain outlet 800. The debris trap 100 is dimensioned to be disposed within the drainpipe 810 with the bristles 115 extending radially to contact the inner surface of the drainpipe 810. The cap 105 is raised from the drain outlet 800 to permit the flow of water.

Figure 9:
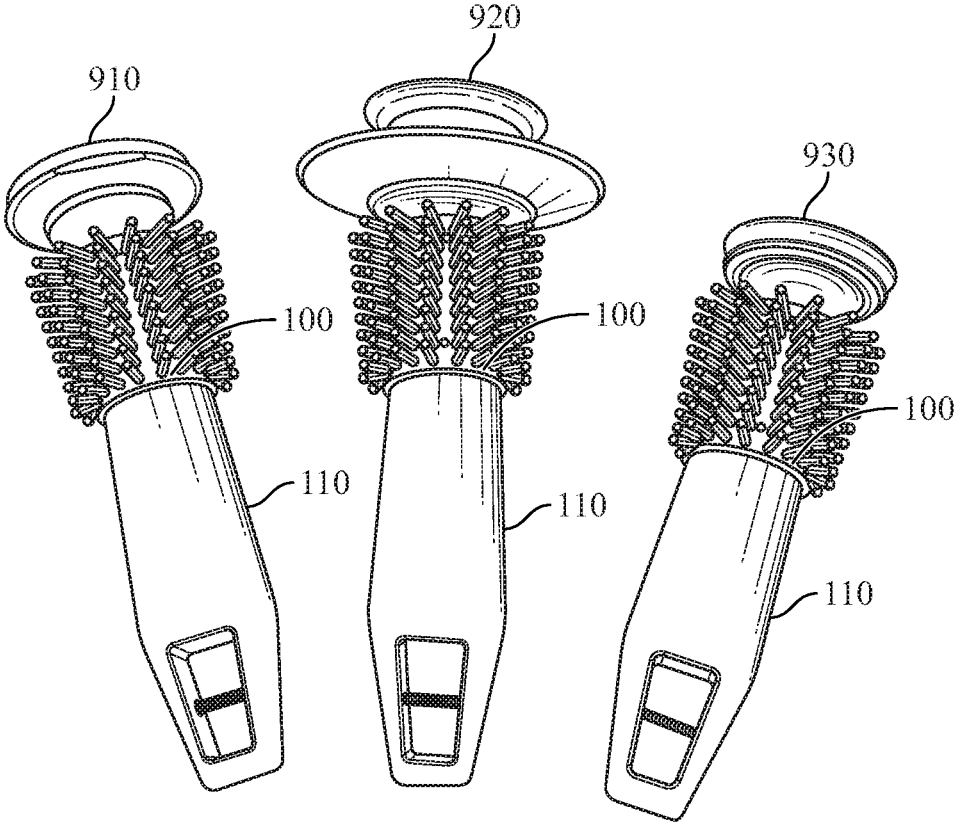
FIG. 9 illustrates perspective views of the drain stopper and removable debris trap with various caps, according to some embodiments.

FIG. 9 illustrates alternate embodiments, and specifically, a first cap 910, second cap 920, and third cap 930 configurations. Each cap configuration 910, 920, 930 is removable from the stem 110 and debris trap 100.

In some embodiments, the removal of the cap 105 permits the release of the debris trap 100. The debris trap 100 may be provided as one of a set or kit such that when the debris trap 100 degrades, becomes entangled with debris, or is otherwise ineffective, it may be replaced without the user needing to untangle the debris caught by the bristles.

Figure 10:
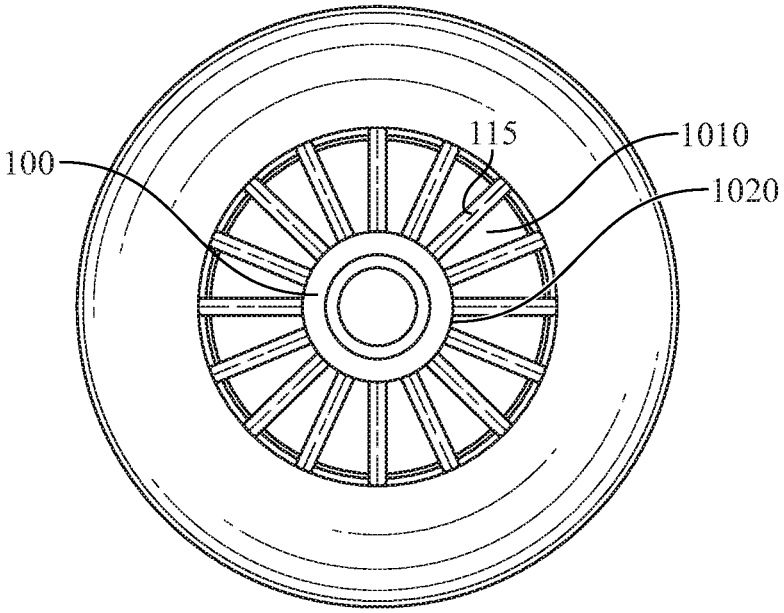
FIG. 10 illustrates a top plan view of the drain stopper with a removed cap to show the debris trap within a drainpipe, according to some embodiments.

FIG. 10 illustrates a top view of the debris trap 100 disposed in a drainpipe. The bristles 115 extend radially from the debris trap 100 to contact the inner surface 1010 of the drainpipe. The space between the outer surface 1020 of the debris trap 100 and the inner surface 1010 permits the flow of water while the bristles 115 catch debris without substantially impeding the flow of water.

Figure 11:
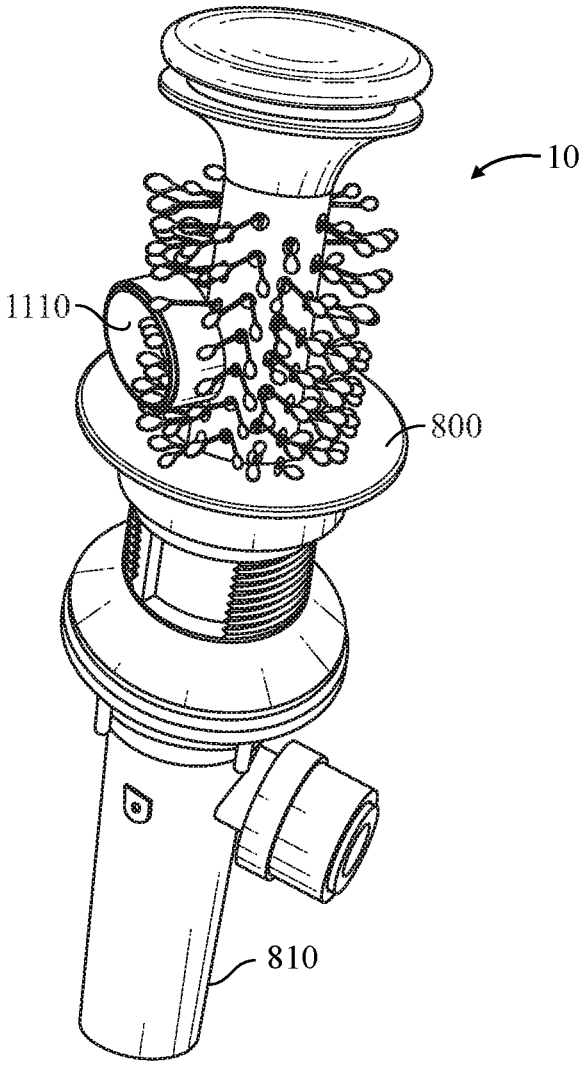
FIG. 11 illustrates a perspective view of the drain stopper extending from a drain outlet, according to some embodiments.

FIG. 11 illustrates debris 1110 entangled in the bristles 115. During use, the user positions the apparatus 10 in the raised position to at least partially extend the debris trap from the drain outlet 800 and remove the debris 1110 or replace the removable debris trap. In such, the drainpipe 810 is unclogged without the use of chemicals.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A drain stopper assembly with a removable debris trap, comprising:

a drain stopper assembly comprises a central portion extending between a stem and a removable cap;

a removable debris trap slidingly engaged with the central portion, the removable debris trap retained between the stem and the removable cap, the removable debris trap comprised of a plurality of bristles radially extending from a plurality of apertures positioned throughout an outer surface of the removable debris trap to trap debris entering a drain outlet;

wherein the removable cap is threadingly engaged with the central portion, and wherein removal of the cap permits removal of the removable debris trap;

wherein the stem comprises an adjustment mechanism permitting a raised position and a lowered positioned, whereby in the raised position the cap is positioned at a spaced distance from the drain outlet to permit wastewater to drain into the drainpipe, and in the lowered position the cap forms a hermetic seal with a drain outlet to prevent wastewater from draining into a drainpipe;

wherein the adjustment mechanism permits the spaced distance between the cap and the drain outlet to be incrementally adjusted.

2. The drain stopper assembly of claim 1, wherein the removable debris trap is dimensioned to be at least partially disposed in a drainpipe.

3. The drain stopper assembly of claim 1, wherein the removable drain trap is disposable.

4. A drain stopper assembly with a removable debris trap, comprising:

a drain stopper assembly including a central portion extending between a stem and a removable cap, the stem comprising an adjustable mechanism permitting a raised position and a lowered positioned, the central portion configured to receive and retain a removable debris trap between the stem and the removable cap, the removable debris trap comprised of a plurality of bristles having ends radially extending from an outer surface of the removable debris trap toward an inner surface of a drainpipe, the plurality of bristles arranged to trap debris entering a drain outlet;

whereby in the raised position the cap is positioned at a spaced distance from the drain outlet to permit wastewater to drain into the drainpipe, and in the lowered position the cap forms a hermetic seal with a drain outlet to prevent wastewater from draining into a drainpipe;

wherein the cap comprises a flange portion at a bottom end of the cap, the flange portion configured to facilitate the formation of the hermetic seal between a lower surface of the cap and a seat of the drain outlet when in the lowered position;

wherein the flange portion comprises a circumferential outer portion that is coplanar with the lower surface of the cap, and a conical inner portion that is downward-facing in the raised position.

5. The drain stopper assembly of claim 4, wherein the bottom end of the cap has a circumference that is greater than a circumference of an upper rim of the removable debris trap.

6. The drain stopper assembly of claim 5, wherein the stem comprises a top end having a circumference that is greater than a circumference of a lower rim of the removable debris trap.

7. The drain stopper assembly of claim 4, wherein the removable drain trap is disposable.

8. The drain stopper assembly of claim 1, wherein the cap comprises a flange portion at a bottom end of the cap, the flange portion configured to facilitate the formation of the hermetic seal between a lower surface of the cap and a seat of the drain outlet when in the lowered position;

wherein the flange portion comprises a circumferential outer portion that is coplanar with the lower surface of the cap, and a conical inner portion that is downward-facing in the raised position.

9. The drain stopper assembly of claim 1, wherein the drain stopper assembly is at least partially disposable in a bathtub drain outlet, a floor drain outlet, or a sink drain outlet.

10. The drain stopper assembly of claim 4, whereby in the raised position the spaced distance between the cap and the drain outlet is adjusted by the adjustment mechanism.

11. The drain stopper assembly of claim 4, wherein the removable debris trap is configured to slidingly engage the central portion.

12. The drain stopper assembly of claim 4, wherein the drain stopper assembly is at least partially disposable in a bathtub drain outlet, a floor drain outlet, or a sink drain outlet.

* * * * *